US006013903A

United States Patent [19]

Mifune et al.

[11] Patent Number: 6,013,903

[45] Date of Patent: Jan. 11, 2000

[54] FLAME REACTION MATERIAL CARRIER AND METHOD OF MANUFACTURING FLAME REACTION MEMBER

[76] Inventors: Hideo Mifune; Masato Seki; Noriyuki Serizawa, all of C/o Tokai Corporation, 3-4 Shimohara, Subashiri, Oyama-cho, Sunto-gun, Shizuoka-ken, Japan

[21] Appl. No.: 08/935,143

[22] Filed: Sep. 22, 1997

[30] Foreign Application Priority Data

Sep. 24, 1996 [JP] Japan ..... 8-251500
Oct. 4, 1996 [JP] Japan ..... 8-264155

[51] Int. Cl.[7] ..... H05B 3/10

[52] U.S. Cl. ..... 219/552; 219/553; 219/541; 338/141; 338/278; 338/282

[58] Field of Search ..... 219/538, 542, 219/543, 546, 548, 552, 553; 338/278, 282, 297, 177, 141, 143

[56] References Cited

U.S. PATENT DOCUMENTS 3,173,123 3/1965 Achner ..... 338/304
3,191,138 6/1965 Wycoff ..... 338/287
3,596,057 7/1971 Arntz et al. ..... 219/353
3,984,615 10/1976 Beck ..... 13/25
4,230,933 10/1980 Glucksman et al. ..... 219/375

FOREIGN PATENT DOCUMENTS 3-110321 5/1991 Japan .
7-72615 8/1995 Japan .

*Primary Examiner*—Archene Turner
*Attorney, Agent, or Firm*—Baker & Botts, LLP

[57] ABSTRACT

A flame reaction member for a gas appliance has a flame reaction material carrier having a coiled or looped flame reaction material holding portion and flame reaction material carried on the flame reaction material holding portion. When manufacturing such a flame reaction member, a powder composition of the flame reaction material is molded into a body of a predetermined shape. The molded body is heated with the molded body held adjacent to the flame reaction material holding portion and is fused to the flame reaction material holding portion. The flame reaction material holding portion of the flame reaction material carrier is formed of flat wire material.

5 Claims, 8 Drawing Sheets

FLAME REACTION MATERIAL CARRIER AND METHOD OF MANUFACTURING FLAME REACTION MEMBER

BACKGROUND OF THE INVENTION

1. Field of the Invention

This invention relates to a flame reaction material carrier which carries a flame reaction material for coloring a gas flame in a gas appliance such as a cigarette lighter, an ignitor, a torch or the like, and a method of manufacturing a flame reaction member comprising a flame reaction material carrier and a flame reaction material carried by the flame reaction member.

2. Description of the Related Art

It has been proposed to color a gas flame of a cigarette gas lighter or the like by flame reaction in order to make visible the gas flame or to improve appearance of the flame. As disclosed, for instance, in Japanese Patent Publication No. 7(1995)-72615, a flame reaction material is held in a gas flame by a carrier formed of a coiled heat-resistant wire material and the gas flame is colored by flame reaction. As another flame reaction material carrier, there has been known one formed of a wire material an intermediate portion of which is wound into a loop. The flame reaction material is fixed on the looped portion.

Since the flame reaction material carried by the carrier is volatilized by the flame it is consumed as the lighter or the like is repeatedly used. Accordingly basically the amount of the flame reaction material carried by the carrier should be as large as possible.

However as the amount of flame reaction material provided on the carrier is increased, the size of the carrier must be larger and the overall size of the flame reaction member is increased. As the size of the flame reaction member increases, resistance of the flame reaction member to the gas flow increases and the gas flow is disturbed, which makes unstable the shape of the gas flame. From this viewpoint, it is preferred that the flame reaction member be as small as possible.

Thus the flame reaction member should carry a necessary amount of flame reaction material and should be as small as possible in size. However in conventional flame reaction members where the flame reaction material carrier is formed by coiling or looping a heat-resistant wire material which is circular in cross-section, the diameter or the pitch of the coiled portion or the loop must be increased in order to increase the amount of the flame reaction material carried thereon, which increases the overall size of the flame reaction member and gives rise to the aforesaid problem.

For example, in the case of a cigarette lighter, it is preferred that a flame reaction member comprising a flame reaction material carrier in the form of a coiled heat-resistant wire member and flame reaction material carried on the carrier be transversely suspended in the gas burner of the lighter in view of stability in the color developed by flame reaction and advancing initiation of developing the color. A burner of primary air mixing type employed in a flame reaction lighter generally has a burner tube which is 6 mm in the inner diameter and the rate of gas flow through the burner tube is generally set to about 35 cc/min. In such a case, the outer diameter of the portion of the carrier where it carries the flame reaction material should be not larger than about 1.3 mm. Otherwise the shape of the gas flame becomes unstable.

Further the amount of flame reaction material necessary for one thousand ignitions of a cigarette lighter is about 10 mg and is about 15 mg if a margin is left. When the diameter of the wire material of the carrier and the pitch at which the wire material is coiled are set so that a sufficient strength of the flame reaction member is ensured with such an amount of flame reaction material carried on the carrier, the outer diameter of the flame reaction member is enlarged to adversely affect the gas flame. On the other hand, when the diameter of the coiled portion is reduced in order to avoid such adverse influence on the flame, the amount of flame reaction material which can be carried by the carrier is reduced and the service life of the flame reaction member is shortened, whereby the flame reaction material is exhausted before the service life of the lighter expires and the coloring effect cannot be obtained any more.

Further in order to make the flame reaction member as small as possible without fear that the flame reaction material is exhausted before the service life of the lighter expires, it is necessary to precisely control the amount of flame reaction material provided on the carrier so that an adequate amount of flame reaction material is uniformly provided on the carrier.

Conventionally, a flame reaction material composition in the form of viscous solution is applied to the carrier by coating or dipping and fixed to the carrier by baking. However this method is disadvantageous in that control of the amount of flame reaction material provided on the carrier is difficult and requires skillfulness, and it is difficult to apply a uniform amount of flame reaction material to the carrier.

Further in the step of applying the viscous solution to the carrier, the solution can contaminate the working environment. Further the viscosity of the solution changes with time due to evaporation of the liquid component, whereby the amount of solution applied to the carrier changes, and accordingly, the viscosity of the solution must be carefully controlled in order to uniform the amount of flame reaction material provided on the carrier.

SUMMARY OF THE INVENTION

In view of the foregoing observations and description, the primary object of the present invention is to provide a flame reaction material carrier which can hold a large enough amount of flame reaction material and at the same time can reduce the overall size of the flame reaction member.

Another object of the present invention is to provide a method of manufacturing a flame reaction member which makes it feasible to provide a uniform amount of flame reaction material on the carrier with ease.

In accordance with a first aspect of the present invention, there is provided a flame reaction material carrier having a coiled or looped flame reaction material holding portion on which flame reaction material is to be carried, wherein the improvement comprises that said flame reaction material holding portion is formed by winding heat-resistant wire material which is flat in cross-section.

The flame reaction material holding portion may be formed by rolling round stock wire material flat and winding the resulting flat wire material or by winding strip like material which is inherently flat in cross-section.

The flame reaction material holding portion may be wound either so that the flat sides of the wire material are parallel to the center line about which the flame reaction material holding portion is wound, so that the flat sides of the wire material are perpendicular to the center line or so that the flat sides of the wire material are at an angle to the center line.

It is preferred that flame reaction material be fused to the flame reaction material holding portion.

When the holding portion is formed of flat wire material, the surface area of the holding portion for a given cross-sectional area becomes larger than that of the holding portion formed of round wire material. Since the contact area with flame reaction material is increased, the flame reaction material supporting capacity is increased, whereby the winding pitches can be larger and the flame reaction member can be smaller in overall size. Further the gas flame can be colored by flame reaction for a longer time while maintaining a good shape of the flame since the flame reaction member can hold a sufficient amount of flame reaction material for a relatively small size thereof. Further since the contact area of the flame reaction material with the gas flame is large, the coloring time is shortened.

In the case of a flame reaction member where the flame reaction material holding portion is formed by winding flat wire material so that the flat sides of the wire material are parallel to the center line, the inner diameter of the holding portion for a given outer diameter thereof can be larger than that of the flame reaction material holding portion formed by winding round wire material and accordingly the flame reaction member can hold a larger amount of flame reaction material. Further in the case of a flame reaction member where the flame reaction material holding portion is formed by winding flat wire material so that the flat sides of the wire material are perpendicular or at an angle to the center line, the holding portion can hold the flame reaction material in contact therewith over a large area from the outer periphery to the inner periphery and accordingly even if the amount of the flame reaction material is reduced due to consumption, the residual material can be well held by the holding portion and at the same time the contact area of the flame reaction material with the flame is large, which results in a short coloring time.

In accordance with a second aspect of the present invention, there is provided a method of manufacturing a flame reaction member comprising a flame reaction material carrier having a coiled or looped flame reaction material holding portion formed of heat-resistant wire material and flame reaction material carried on the flame reaction material holding portion, wherein the improvement comprises the steps of molding a powder composition of said flame reaction material into a body of a predetermined shape, heating the molded body with the molded body held adjacent to the flame reaction material holding portion of the flame reaction material carrier, and fusing the molded body to the flame reaction material holding portion.

In accordance with a third aspect of the present invention, there is provided a method of manufacturing a flame reaction member comprising a flame reaction material carrier having a coiled or looped flame reaction material holding portion formed of heat-resistant wire material and glassy flame reaction material carried on the flame reaction material holding portion, wherein the improvement comprises the steps of melting a glassy powder composition of said flame reaction material, molding the molten glassy powder composition into a body of a predetermined shape such as a tube, bead, rod, ball or the like, heating the molded body with the molded body held adjacent to the flame reaction material holding portion of the flame reaction material carrier, and fusing the molded body to the flame reaction material holding portion.

In the method of the second and third aspects of the present invention, it is preferred that the molded body be in the form of a ring or a tube and be fused to the holding portion with the holding portion inserted through the ring or the tube. It is also preferred that the molded body be in the form of a channel and be fused to the holding portion with the channel placed on the holding portion. Further it is also preferred that the molded body be in the form of a rod and be fused to the holding portion with the rod inserted through the holding portion.

It is possible to sinter and strengthen the molded body before fusing the molded body to the holding portion.

Further it is preferred that the flame reaction material holding portion of the flame reaction material carrier be formed of flat wire material as described above in conjunction with the flame reaction member in accordance with the first aspect of the present invention.

In accordance with the methods of the second and third aspects of the present invention, the flame reaction material can be provided on the holding portion of the flame reaction material carrier by a dry method, which is advantageous over the conventional wet method in that the amount of the flame reaction material provided on the flame reaction material carrier can be made uniform more easily than by the wet method and the step of providing the flame reaction material on the flame reaction material carrier is facilitated. Thus in accordance with the methods of the present invention, workability is improved and the working environment can be improved. That is, the step of applying a viscous solution of the flame reaction material composition, which requires skillfulness and much labor, becomes unnecessary and at the same time the step of controlling the viscosity of the solution, which changes due to evaporation of the liquid components, becomes unnecessary. Further the flame reaction material can be provided on the flame reaction material carrier by simply placing or inserting the molded body on or into the holding portion and fusing it to the holding portion, whereby productivity of the flame reaction members can be improved, the amounts of flame reaction material on the individual flame reaction members can be made uniform and the conditions of the flame reaction material provided on the individual flame reaction material carriers can be made uniform, which results in a higher reliability of the products.

Further when the flame reaction material is glassy and the flame reaction material is provided on the holding portion by molding a powder composition of the flame reaction material into a body of a predetermined shape, sintering the molded body and fusing the molded body to the flame reaction material holding portion, or by melting a glassy powder composition of the flame reaction material, molding the molten glassy powder composition into a body of a predetermined shape, heating the molded body, and fusing the molded body to the flame reaction material holding portion, the molded body is strengthened by vitrification and is prevented from being broken or cracked upon setting it to the holding portion.

DESCRIPTION OF THE PREFERRED EMBODIMENT

Figure 1:
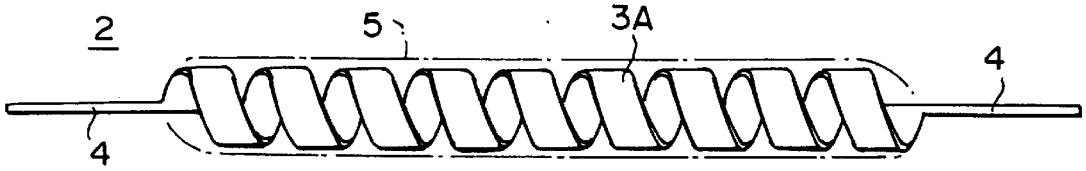
FIG. 1 is a front view showing a flame reaction material carrier in accordance with a first embodiment of the present invention.
Figure 2:
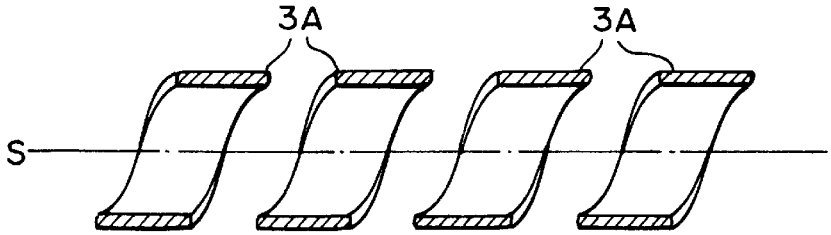
FIG. 2 is a fragmentary cross-sectional view of the flame reaction material carrier.

In FIGS. 1 and 2, a flame reaction material carrier 2 in accordance with a first embodiment of the present invention is formed of a heat-resistant wire material such as nichrome wire and comprises a coiled flame reaction material holding portion 3A and linear mounting portions 4 on opposite ends of the flame reaction material holding portion 3A. The portion of the heat-resistant wire material forming the flame reaction material holding portion 3A is flat in cross-section and is coiled into a predetermined diameter at predetermined pitches with the major side in parallel to the center line S (FIG. 2) about which the flame reaction material holding portion 3A is coiled. The portions of the heat-resistant wire material forming the mounting portions 4 may be either circular or flat in cross-section.

Further the flat shape of the wire material forming the flame reaction material holding portion 3A may be freely designed according to the diameter and the like of the stock wire material, it is preferred that the flatness (the ratio of the width or the dimension of the major side to the thickness or the dimension of the minor side) be about 2 to 5. When round stock wire material is rolled flat, it is preferred that the ratio of the width of the rolled wire material to the diameter of the stock wire material be about 1.5 to 2.5.

For example, the flame reaction material holding portion 3A is formed by rolling nickel chrome alloy wire material of 0.2 mm in diameter into flat wire material having a thickness of 0.07 mm and a width of 0.38 mm and winding the flat wire material about the center line S into a coil having an outer diameter of 1.1 mm and an inner diameter of 0.96 mm so that the flat surface (major side) of the flat wire material is parallel to the center line S.

The flame reaction material holding portion 3A formed in this manner is larger in the inner diameter than one formed by coiling round stock wire material and having the same outer diameter. Specifically when round wire material having a diameter of 0.15 mm is wound into a coil having an outer diameter of 1.0 mm, the inner diameter of the coil is 0.7 mm and the internal area of the coil is 0.38 $mm^2$. To the contrast, when round wire material of 0.15 mm in diameter is rolled into flat wire material having a thickness of 0.07 mm and a width of 0.28 mm and the flat wire material is wound into a coil having an outer diameter of 1.0 mm, the inner diameter of the coil is 0.86 mm and the internal area of the coil is 0.58 $mm^2$, which results in the internal volume of the coil which is 1.53 times as large as that of the coil formed by winding the round wire material.

Flame reaction material 5 is held by the flame reaction material holding portion 3A of the flame reaction material carrier 2. The flame reaction material 5 is provided on the flame reaction material holding portion 3A, for instance, by fusing a low-melting glassy material to the flame reaction material holding portion 3A. In the case of flame reaction material for blue green flame, the flame reaction material 5 may comprise, for instance, CuO, $B_2O_3$ and $Al_2O_3$ (as flame reaction components) mixed with low-melting glass frit. Specifically, a 70:20:10 composition of CuO, $B_2O_3$ and $Al_2O_3$ is mixed with 30% of low-melting glass frit and then binder (washing size) is added to the mixture to form a coating solution in the form of viscous liquid. The coating solution is applied to the flame reaction material holding portion 3A of the flame reaction material carrier 2 and baked at 900° C. for ten minutes, whereby about 17 mg of flame reaction material 5 is fused to the carrier 2 and a flame reaction member 1 is obtained.

Figure 8:
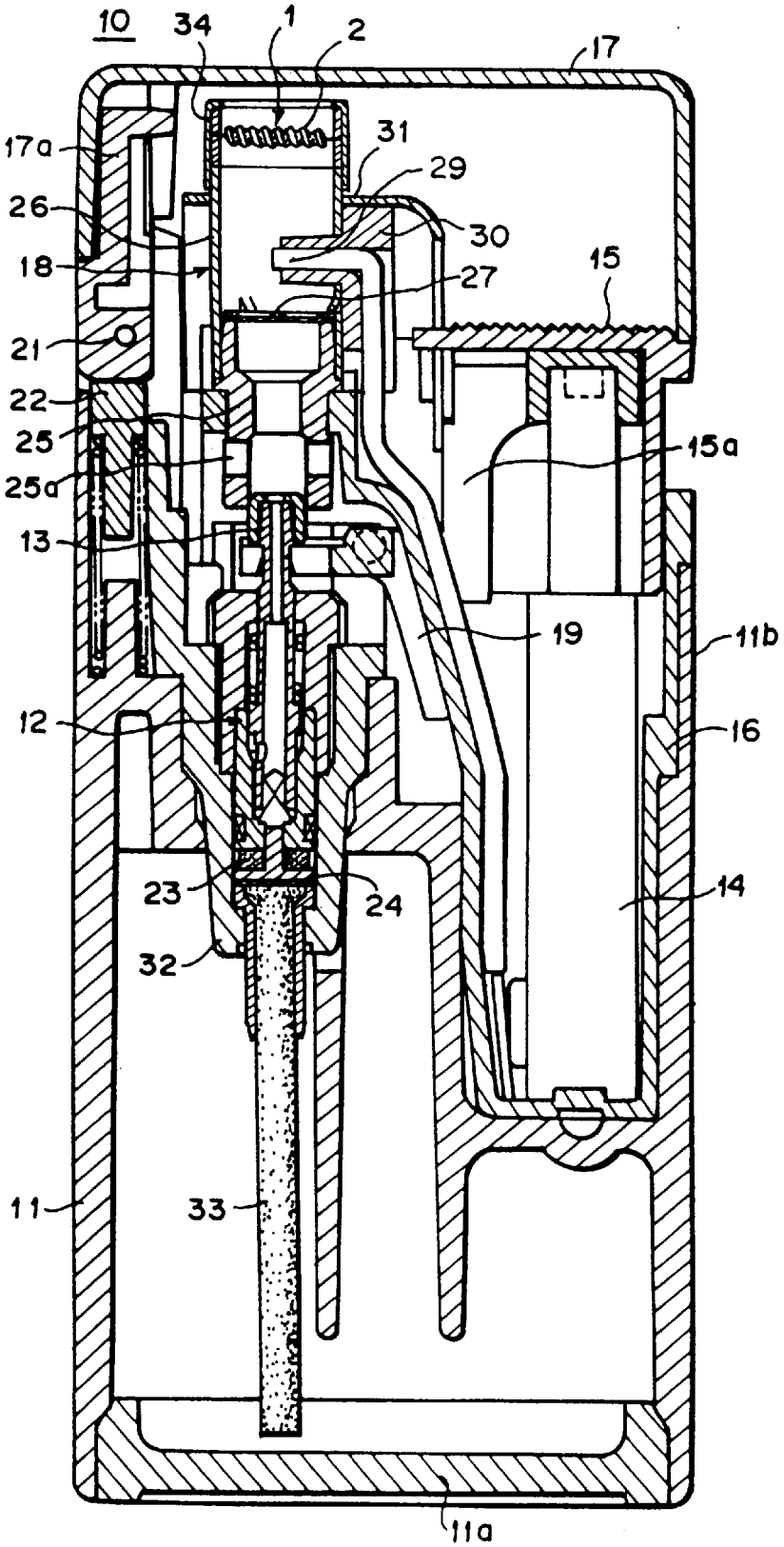
FIG. 8 is a cross-sectional view of a cigarette lighter provided with a flame reaction member comprising a flame reaction material carrier of the present invention.
Figure 9:
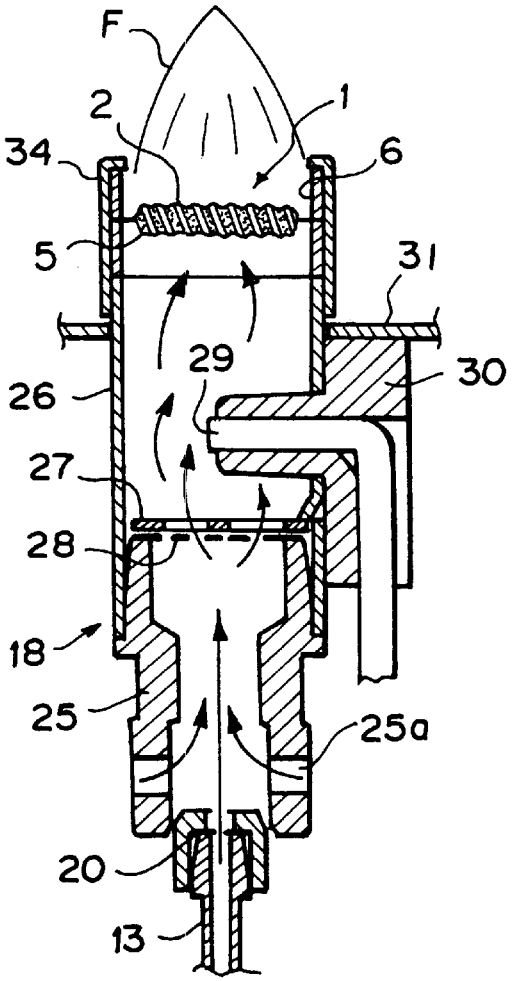
FIG. 9 is an enlarged cross-sectional view of an important part of the lighter.

When the flame reaction member 1 thus obtained is incorporated in a burner 18 of a cigarette lighter 10 (gas flow rate of 35 cc/min) shown in FIGS. 8 and 9, a green flame lighter which can color flame in green for more than one thousand ignitions can be obtained.

In the case of flame reaction material for magenta flame, the flame reaction material 5 may comprise a 40:50:10 composition of $Li_2Co_3$, $SiO_2$ and $Al_2O_3$ mixed with 30% of low-melting glass frit. In the case of flame reaction material for orange yellow flame, the flame reaction material 5 may comprise a 67:33 composition of $Na_2Co_3$ and $SiO_2$ mixed with 30% of low-melting glass frit. These flame reaction materials may be applied to the flame reaction material holding portion 3A of the flame reaction material carrier 2 and fused to the carrier 2 in the manner described above.

Figure 3:
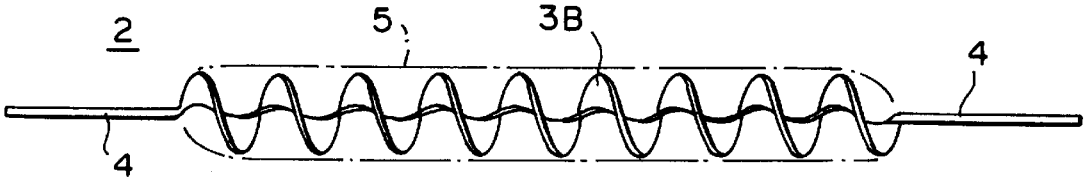
FIG. 3 is a front view showing a flame reaction material carrier in accordance with a second embodiment of the present invention.
Figure 4:
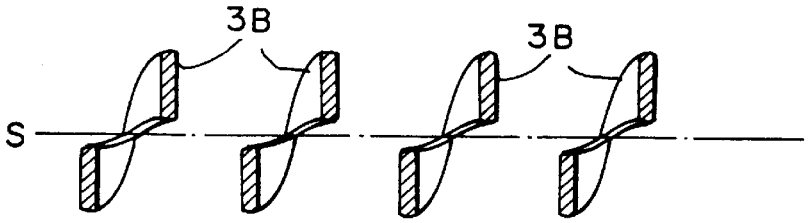
FIG. 4 is a fragmentary cross-sectional view of the flame reaction material carrier.

FIGS. 3 and 4 show a flame reaction material carrier 2 in accordance with a second embodiment of the present invention. As in the first embodiment, the flame reaction material carrier 2 of this embodiment is formed of a heat-resistant wire material and comprises a coiled flame reaction material holding portion 3B and linear mounting portions 4 on opposite ends of the flame reaction material holding portion 3B. The portion of the heat-resistant wire material forming the flame reaction material holding portion 3B is flat in cross-section and is coiled into a predetermined diameter at predetermined pitches with the major side in perpendicular to the center line S.

For example, the flame reaction material holding portion 3B is formed by rolling nickel chrome alloy wire material of 0.2 mm in diameter into flat wire material having a thickness of 0.07 mm and a width of 0.38 mm and winding the flat wire material about the center line S into a coil having an outer diameter of 1.1 mm, an inner diameter of 0.34 mm and pitches of 0.85 mm so that the flat surface (major side) of the flat wire material is perpendicular to the center line S.

Viscous solution of flame reaction material composition is applied to the flame reaction material holding portion 2B of the flame reaction material carrier 2 and fused thereto in the same manner as described above, whereby about 19 mg of flame reaction material 5 is fused to the carrier 2 and a flame reaction member 1 is obtained.

When the flame reaction member 1 thus obtained is incorporated in the burner 18 of the cigarette lighter 10, a color flame lighter which can color flame for more than one thousand ignitions and can color the flame within a time less than two seconds can be obtained.

The flame reaction material holding portion 3B formed in this manner is larger in the area over which the flame reaction material 5 can be fused than one formed by coiling round stock wire material and having the same outer diameter though smaller in the inner diameter. Specifically the circumference of round wire material having a diameter of 0.15 mm is 0.47 mm whereas the circumference of wire material obtained by rolling round wire material having a diameter of 0.15 mm into flat wire material having a thickness of 0.07 mm and a width of 0.28 mm is 0.64 mm, which is 1.36 times as large as that of the round wire material. When the round wire material and flat wire material are wound into coils having an outer diameter of 1.0 mm, the inner diameter of the coil of the flat wire material is 0.44 mm and is smaller than that of the coil of the round wire material. However the coil of the flat wire material is larger than the coil of the round wire material in the surface area and accordingly can carry a larger amount of flame reaction material. Further in the flame reaction material holding portion 3B of the flat wire material, the surface area over which the flame reaction material is directly brought into contact with the flame is enlarged, which is advantageous in color development.

Figure 5:
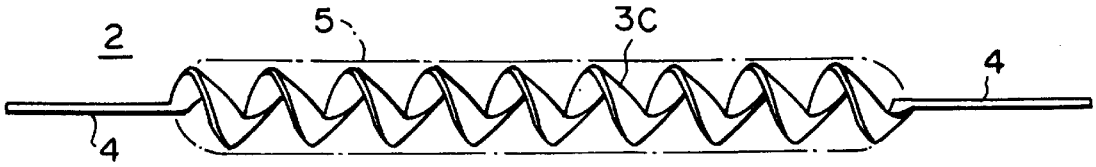
FIG. 5 is a front view showing a flame reaction material carrier in accordance with a third embodiment of the present invention.
Figure 6:
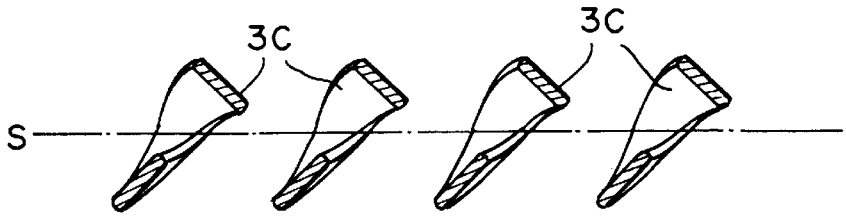
FIG. 6 is a fragmentary cross-sectional view of the flame reaction material carrier.

FIGS. 5 and 6 show a flame reaction material carrier 2 in accordance with a third embodiment of the present invention. As in the first and second embodiments, the flame reaction material carrier 2 of this embodiment is formed of a heat-resistant wire material and comprises a coiled flame reaction material holding portion 3C and linear mounting portions 4 on opposite ends of the flame reaction material holding portion 3C. The portion of the heat-resistant wire material forming the flame reaction material holding portion 3C is flat in cross-section and is coiled into a predetermined diameter at predetermined pitches with the major side at an angle to the center line S.

For example, the flame reaction material holding portion 3C is formed by rolling nickel chrome alloy wire material of 0.2 mm in diameter into flat wire material having a thickness of 0.07 mm and a width of 0.38 mm and winding the flat wire material about the center line S into a coil having an outer diameter of 0.9 mm, an inner diameter of 0.36 mm and pitches of 0.85 mm so that the flat surface (major side) of the flat wire material is at 45° to the center line S.

Coating solution including a flame reaction material composition is applied to the flame reaction material holding portion 2C of the flame reaction material carrier 2 and fused thereto in the same manner as described above, whereby about 15 mg of flame reaction material 5 is fused to the carrier 2 and a flame reaction member 1 is obtained. When the flame reaction member 1 thus obtained is incorporated in the burner 18 of the cigarette lighter 10, a color flame lighter which can color flame for more than one thousand ignitions and can color the flame within a time less than two seconds can be obtained. Further the flame reaction material carrier 2 is small in diameter and accordingly hardly affects the shape of the flame.

Though each of the flame reaction material carriers 2 in accordance with the first to third embodiments described above has mounting portions 4, the flame reaction material carrier 2 need not have such a mounting portion. In this case, a coil in a continuous length may be formed and then cut into individual flame reaction material carriers 2 of a predetermined length. The flame reaction material may be provided on the coil in a continuous length before cutting or may be provided on the individual flame reaction material carriers 2.

The amounts of flame reaction material carried on flame reaction material carriers 2 formed of flat wire material in accordance with the present invention and flame reaction material carriers formed of round wire material were measured. The result is shown in the following table 1.

Nickel chrome alloy wire material of 0.2 mm diameter was rolled into flat wire material having a thickness of 0.07 mm and a width of 0.38 mm and the flat wire material was wound about the center line S at pitches of 0.8 mm so that the flat surface (major side) of the flat wire material was parallel to the center line S as shown in FIG. 1 (this will be referred to as "parallel winding", hereinbelow). In this manner, coils having outer diameters of 0.7 mm, 0.9 mm, 1.1 mm and 1.3 mm were prepared.

Further flat wire material having the same dimensions was wound about the center line S at pitches of 0.8 mm so that the flat surface (major side) of the flat wire material was perpendicular to the center line S as shown in FIG. 3 (this will be referred to as "perpendicular winding", hereinbelow). In this manner, coils having outer diameters of 0.9 mm, 1.1 mm and 1.3 mm were prepared.

Further flat wire material having the same dimensions was wound about the center line S at pitches of 0.8 mm so that the flat surface (major side) of the flat wire material was at an angle to the center line S as shown in FIG. 5 (this will be referred to as "slant winding", hereinbelow). In this manner, coils having outer diameters of 0.9 mm, 1.1 mm and 1.3 mm were prepared.

Further round wire material having a diameter of 0.15 mm was wound at pitches of 0.8 mm and coils having outer diameters of 0.7 mm, 0.9 mm, 1.1 mm and 1.3 mm were prepared.

Viscous coating solution of the aforesaid green flame reaction material was applied to the flame reaction material holding portion (6.4 mm long) of each of the flame reaction material carriers thus obtained and heated above the melting point of the flame reaction material, thereby fusing the flame reaction material to the holding portion.

TABLE 1

| | amount of material (mg) | | | |
|---|---|---|---|---|
| outer diameter | round wire | parallel winding | perpen. winding | slant winding |
| φ0.7 mm | 6.5 | 7.1 | — | — |
| φ0.9 mm | 11.2 | 12.5 | 14.5 | 14.8 |
| φ1.1 mm | 15.3 | 16.9 | 18.6 | 18.6 |
| φ1.3 mm | 19.0 | 22.7 | 24.8 | 25.0 |

As can be seen from table 1, the amount of the flame reaction material carried by the flame reaction material carrier 2 increases as the outer diameter of the holding portion increases. However the amounts of the flame reaction material carried by the flame reaction material carriers formed of flat wire material are larger than those carried by the flame reaction material carriers formed of round wire material though they are the same in the outer diameter. Further the flame reaction material carriers of perpendicular winding and slant winding can carry a larger amount of flame reaction material.

Figure 7:
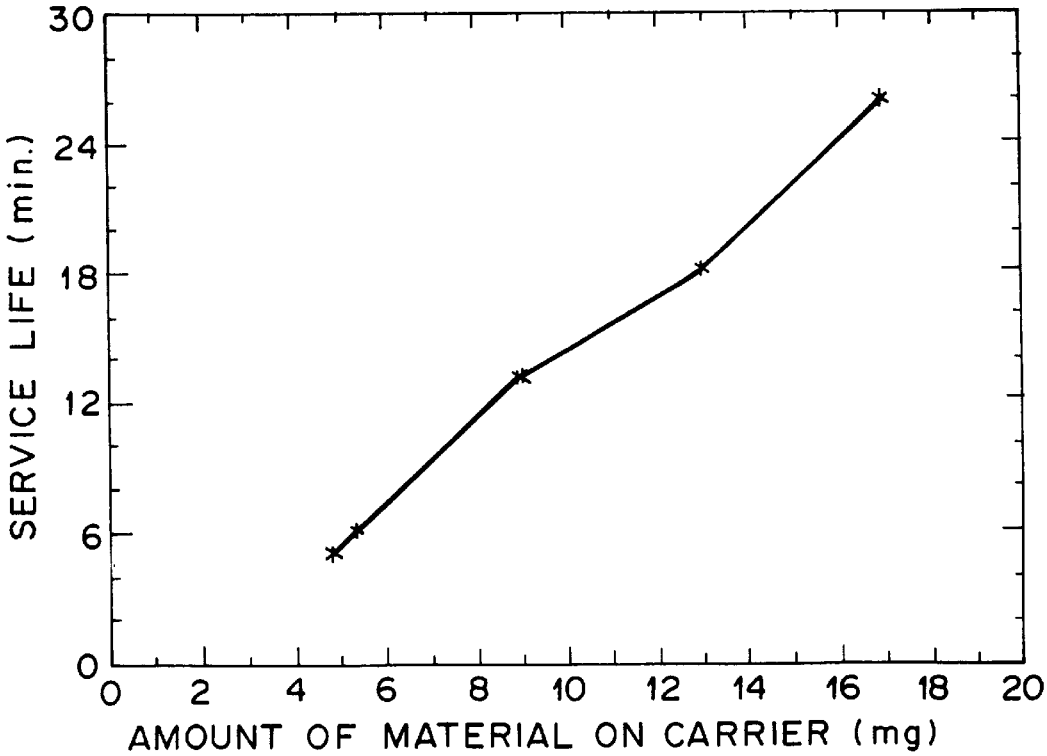
FIG. 7 is a graph showing the relation between the amount of flame reaction material on the flame reaction material carrier and the service life of the flame reaction member.

The relation between the amount of flame reaction material carried by the flame reaction material carrier and the service life of the flame reaction member (for which the flame reaction member can keep coloring the flame) was investigated. The result is shown in FIG. 7. The flame reaction members comprising the aforesaid flame reaction material carriers carrying thereon flame reaction material were mounted on the burner of the cigarette lighter shown in FIGS. 8 and 9 (to be described later) and the lighter was ignited. Then the time for which flame reaction continued was measured as the service life of the flame reaction member.

As can be seen from FIG. 7, the service life of the flame reaction member is substantially proportional to the amount of flame reaction material carried by the flame reaction material carrier and as the amount of flame reaction material carried by the flame reaction material carrier increases, the service life of the flame reaction member increases. In the case of an ordinary cigarette lighter, when 10 mg (preferably 15 mg) of flame reaction material is carried by the flame reaction material carrier 2, the service life of the flame reaction member is about 20 minutes, which is sufficient to keep coloring the flame for one thousand ignitions under a normal condition of use. From this viewpoint, the flame reaction material carrier of parallel winding of 1.1 mm in diameter can carry 16.9 mg of flame reaction material while the flame reaction material carriers of perpendicular winding and slant winding having a diameter of 0.9 mm can carry more than 14 mg of flame reaction material, and they meet the aforesaid conditions.

On the other hand, as the outer diameter of the flame reaction member increases, resistance of the flame reaction member to the gas flow increases and the gas flow is disturbed, which makes unstable the shape of the gas flame. Accordingly the outer diameter of the flame reaction member should be limited to about 1.3 mm and it is preferred that the outer diameter of the flame reaction member be as small as possible. The outer diameter of 1.1 mm can carry a sufficient amount of flame reaction material.

Next the aforesaid samples of flame reaction members were mounted on the burner of the cigarette lighter shown in FIGS. 8 and 9 (to be described later) and the lighter was ignited. Then the coloring time which elapsed before the flame was colored by flame reaction after the lighter was ignited was measured for each sample. The result is shown in the following table 2. Each of the values shown in table 2 are the average values from five measurements. It is preferred that the flame reaction lighter can develop color in a time as short as possible. The smaller the heat capacity of the flame reaction member is, the sooner the temperature of the flame reaction member rises and the shorter the coloring time is. Further the larger the area over which the flame reaction material is brought into contact with the flame is, the shorter the coloring time is.

TABLE 2

| | coloring time (seconds) | | | |
|---|---|---|---|---|
| outer diameter | round wire | parallel winding | perpen. winding | slant winding |
| ϕ0.7 mm | 1.59 | 1.57 | — | — |
| ϕ0.9 mm | 1.77 | 2.02 | 1.55 | 1.59 |
| ϕ1.1 mm | 2.33 | 2.27 | 1.72 | 1.80 |
| ϕ1.3 mm | 2.72 | 3.01 | 2.08 | 2.21 |

As can be seen from table 2, there is a tendency for the coloring time to become shorter as the outer diameter of the flame reaction material carrier becomes smaller. In the case of the flame reaction material carrier of parallel winding, the coloring time is generally longer than that of the flame reaction material carrier of round wire material by the amount corresponding to increase in the amount of flame reaction material carried thereon. However in the case of the flame reaction material carriers of perpendicular winding and slant winding, the coloring time is shorter than that of the flame reaction material carrier of round wire material though the amount of flame reaction material on the former flame reaction material carriers is larger than that on the latter flame reaction material carrier.

An example of gas lighter in which the flame reaction member 1 comprising the flame reaction material carrier 2 is incorporated will be described with reference to FIGS. 8 and 9, hereinbelow.

The gas lighter 10 has a reservoir body 11 in which fuel gas is stored. The reservoir body 11 is molded from synthetic resin and has a bottom lid 11*a* bonded thereto. High-pressure fuel gas such as isobutane is stored in the reservoir body 11. A side wall portion 11*b* extends upward from the top of the reservoir body 11 over the entire circumference thereof. A valve housing 32 containing therein a valve mechanism 12 having a nozzle 13 through which the fuel gas in the reservoir body 11 is injected is mounted on the top of the reservoir body 11. A burner tube 18 in which the fuel gas injected through the nozzle 13 is burnt is mounted above the nozzle 13. In the burner tube 18, the fuel gas is burnt in a primary air intake internal combustion system where primary air is taken in and mixed with the fuel gas.

A piezoelectric unit 14 is disposed beside the valve mechanism 12 and a control member 15 for opening the valve mechanism 12 to inject the fuel gas and actuating the piezoelectric unit 14 to ignite the fuel gas is disposed on the top of the piezoelectric unit 14. The piezoelectric unit 14, the control member 15 and the burner tube 18 are held in an inner housing 16 which is incorporated in the reservoir body 11. A swing lid 17 for covering and uncovering the burner tube 18 and the control member 15 is mounted on the reservoir body 11. That is, a swing member 17*a* is fixed to the lid 17 and is pivoted on the reservoir body 11 by a pin 21. A pusher member 22 for defining the open position and the closing position of the lid 17 is disposed below the swing member 17*a* and is urged upward to be selectively brought into abutment against one of the bottom surface and an outer surface of the swing member 17*a*.

The valve mechanism 12 is arranged so that a gas discharge passage is opened and the fuel gas is injected through the nozzle 13 in response to an upward movement of the nozzle 13. That is, an actuator lever 19 is supported for swinging motion at an intermediate portion thereof and one end of the lever 19 is in engagement with the nozzle 13. A lever pusher 15*a* on the control member 15 pushes the other end of the actuator lever 19 in response to depression of the control member 15, whereby the actuator lever 19 moves the nozzle 13 upward to discharge the fuel gas through the nozzle 13. A nozzle plate 20 (FIG. 9) having an opening of a predetermined diameter (e.g., 50 $\mu$m) is mounted on the top of the nozzle 13 and the top end portion of the nozzle 13 is fitted in the lower portion of the burner tube 18 so that the fuel gas is injected into the burner tube 18 at a high velocity.

The valve mechanism 12 is further provided with a gas flow regulating filter 23 which keeps the injection rate of the fuel gas substantially constant against change in temperature. The regulating filter 23 is fixed to the bottom of the valve mechanism 12 by a fastener 24. The liquid fuel gas moving upward from the reservoir through a porous wick 33 flows through the filter 23 from the outer periphery thereof toward the center thereof and evaporates there. The filter 23 is formed of micro-cellular polymer foam and has open cells which are communicated with each other through pores and form gas passages and closed cells which are expanded and contracted in response to temperature change, thereby compressing or expanding the gas passages to automatically regulate the flow rate of the fuel gas in response to temperature change.

As clearly shown in FIG. 9, the burner tube 18 comprises a base member 25 and a burner pipe 26 which is fixed to the base member 25 and extends upward from the base member 25. A gas passage extending through the base member 25 in the longitudinal direction and the upper end portion of the nozzle 13 is fitted in the lower end portion of the base member 25. A pair of primary air holes 25*a* are formed in the base member 25 above the upper end of the nozzle 13 diametrically opposed to each other.

A swirl plate 27 and a metal mesh member 28 are mounted on the top of the base member 25. The swirl plate 27 is formed by perforating a metal disc and is for generating turbulent flow in the gas flow, thereby promoting mixing of the fuel gas with primary air. The metal mesh member 28 is formed of a disc of metal mesh and is for preventing reverse flow of the flame.

The control member 15 is movable up and down and a discharge electrode 29 connected to the piezoelectric unit 14 projects inward of the burner pipe 26 beside the control member 15. The discharge electrode 29 is held by a holder 30 which extends through the side face of the burner pipe 18.

The base member 25 of the burner tube 18 is engaged with the inner housing 16 at a portion above the primary air holes 25*a*, and thereby held by the inner housing 16 together with the burner pipe 26. The electrode 29 and the holder 30 are incorporated in the burner tube 18 and a cover 31 is mounted over the holder 30 to fix the burner tube 18. The assembly of these elements is assembled with the piezoelectric unit 14 and the control member 15 into a unit by the inner housing 16. Then the unit is incorporated in the reservoir body 11, whereby steps of assembly of the lighter is simplified.

The aforesaid flame reaction member 1 having the flame reaction material carrier 2 is mounted on the burner tube 18 near the upper end of the burner pipe 26. The flame reaction member 1 is mounted on an annular member 6, which has the same diameter as the burner pipe 26, to extend in a diametrical direction of the annular member 6 by fixing the mounting portions 4 to the annular member 6. The annular member 6 carrying thereon the flame reaction member 1 is placed on the top of the burner pipe 26 and a cap 34 is fitted on the annular member 6 and the upper end portion of the burner pipe 26, thereby fixing the annular member 6 to the burner pipe 26 and supporting the flame reaction member 1 above the top of the burner pipe 26.

When the control member 15 is depressed, the lever pusher 15*a* on the control member 15 causes the actuator lever 19 to move the nozzle 13 upward to discharge the fuel gas through the nozzle 13. When the fuel gas is injected through the nozzle 13, primary air is taken in through the primary air holes 25*a* under vacuum generated by the flow of the fuel gas and is mixed with the fuel gas. Then the air-fuel mixture passes through the mesh member 28 for preventing reverse flow and is stirred by the swirl plate 27 and then rises through the burning pipe 26.

In response to further depression of the control member 15, the piezoelectric unit 14 is operated and a high voltage is applied to the electrode 29, whereby a spark is generated from the electrode 29 and the air-fuel mixture is ignited. A part of the flame F burns inside of the burner pipe 26 near the top thereof. The position of the high temperature portion of the flame F depends upon the primary air-fuel ratio and the flow speed of the air-fuel mixture. It is preferred that the flame reaction member 1 be positioned in the high temperature portion.

The flame F burns through the flame reaction member 1. The flame reaction member 1 is brought into contact with the high temperature portion of the flame F and colors the flame F by flame reaction.

Figure 10:
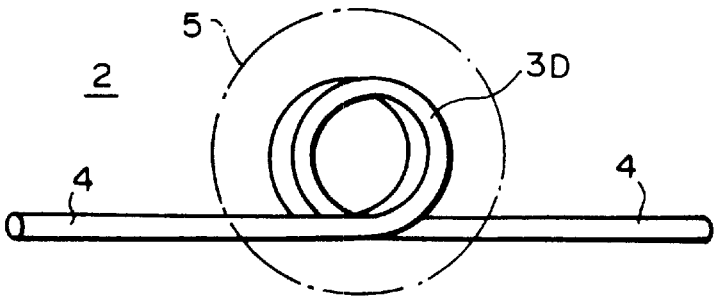
FIG. 10 is a front view showing a flame reaction material carrier in accordance with a fourth embodiment of the present invention.

The flame reaction material carrier 2 may have a flame reaction material holding portion 3D in the form of a loop as shown in FIG. 10.

That is, the flame reaction material holding portion 3D is formed by looping flat wire material one to about five turns and the mounting portions 4 extend in perpendicular to the center line S of the loop. The flame reaction material holding portion 3D may be of any one of the aforesaid parallel winding, perpendicular winding and slant winding.

Figure 11A:
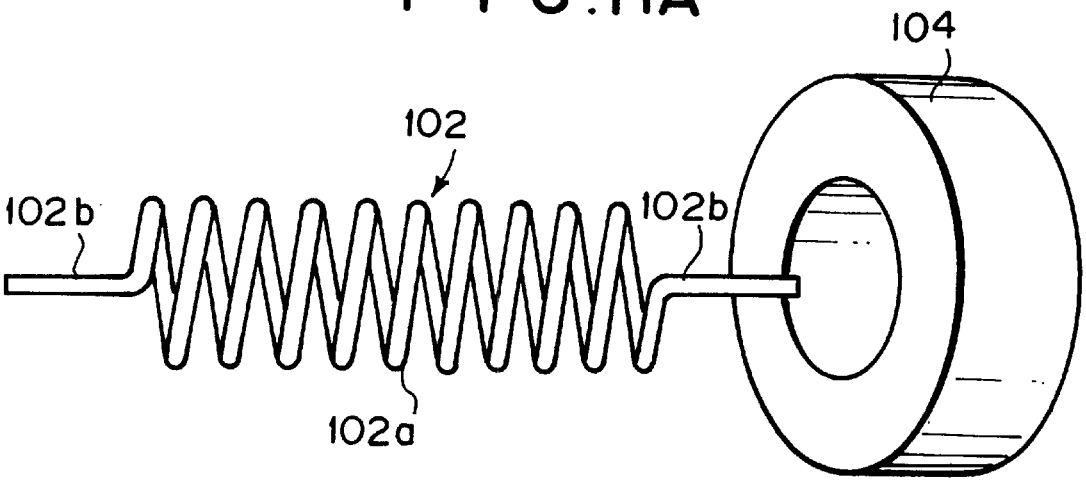
FIGS. 11A to 11C are views illustrating the steps of manufacturing a flame reaction member by a method in accordance with an embodiment of the present invention.
Figure 11B:
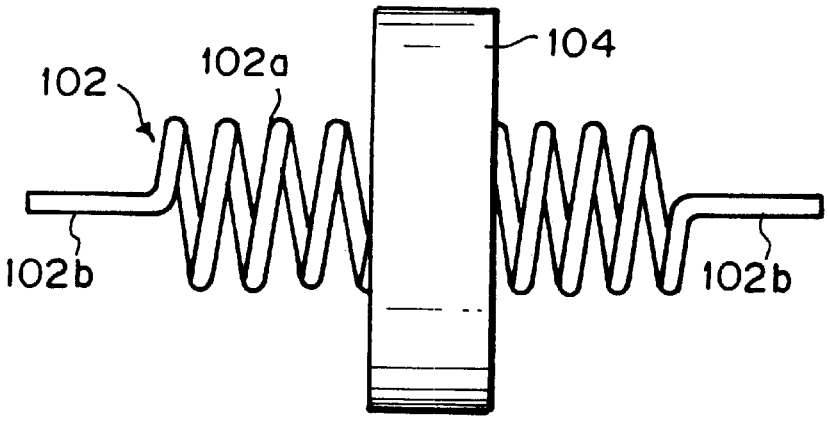

A method of manufacturing a flame reaction member 101 comprising a flame reaction material carrier 102 and flame reaction material 103 in accordance with an embodiment of the present invention will be described with reference to FIG. 11A to 11C, hereinbelow.

Figure 11C:
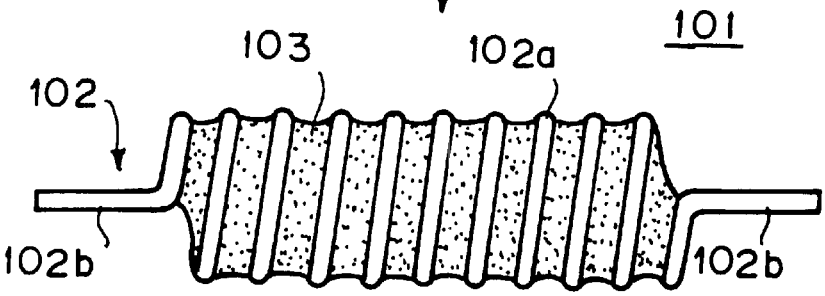

The flame reaction member 101 is formed of heat-resistant wire material and the flame reaction material 103 is carried by a coiled flame reaction material holding portion 102*a* of the flame reaction material carrier 102 as shown in FIG. 11C.

As shown in 11A, a flame reaction material carrier 102 and a molded body 104 of a flame reaction material composition are first prepared. The flame reaction material carrier 102 is formed of a heat-resistant wire material such as nichrome wire and comprises the coiled flame reaction material holding portion 102*a* and linear mounting portions 102*b* on opposite ends of the flame reaction material holding portion 102*a*. The molded body 104 is obtained by molding powder composition of the flame reaction material 103 (to be described later) into a ring.

Then the flame reaction material carrier 102 is inserted into the central opening of the ring-like molded body 104 so that the molded body 104 is held by the holding portion 102*a*. With this state, the molded body 104 is heated to a temperature above the melting point of the flame reaction component, whereby the molded body 104 is melted and the molten composition flows into the inner space of the holding portion 102*a* through the inter-wire spaces. Thereafter the molten composition is solidified and fused to the holding portion 102*a*. In this manner, the flame reaction member 101 shown in FIG. 11C is formed.

For example, the holding portion 102*a* of the flame reaction material carrier 102 is formed by winding nichrome wire material 0.15 mm in diameter into a coil which is 1.1 mm in outer diameter, 0.8 mm in inner diameter, 0.3 mm in pitch and 6.4 mm in length.

The powder composition of the flame reaction material 104 may comprise low-melting point glassy materials. For example, in the case of flame reaction material for blue green flame, the powder composition may comprise CuO, $B_2O_3$ and $Al_2O_3$ (as flame reaction components) mixed with low-melting glass frit. Specifically, a 70:20:10 composition of CuO, $B_2O_3$ and $Al_2O_3$ mixed with 30% of low-melting glass frit may be used. The mixture is charged in a mold and pressed into a ring-like molded body 104. The molded body 104 may be, for instance, 4.0 mm in outer diameter, 1.2 mm in inner diameter, 2.0 mm in thickness and 15 mg in weight.

When the molded body 104 is fused to the holding portion 102*a*, the molded body 104 is heated to 900° C. for 10 minutes.

Figure 12A:
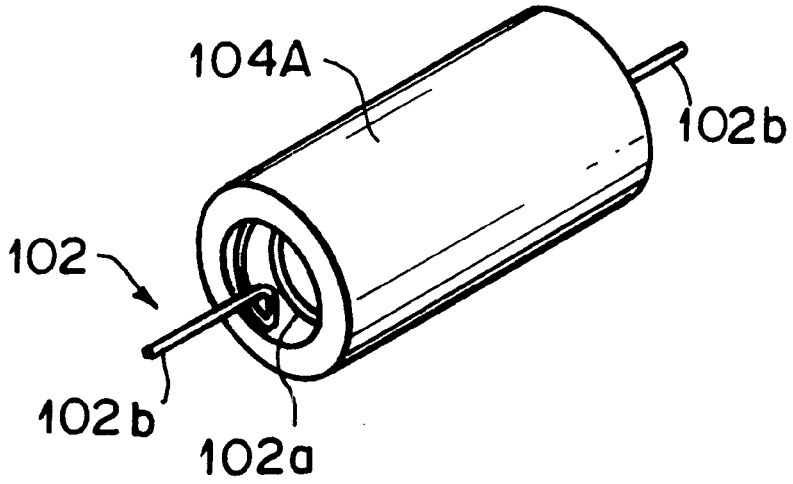
FIGS. 12A to 12C are perspective views showing modifications of the molded body shown in FIG. 11A, FIGS. 13A to 13C are views illustrating the steps of manufacturing a flame reaction member by a method in accordance with another embodiment of the present invention.
Figure 12B:
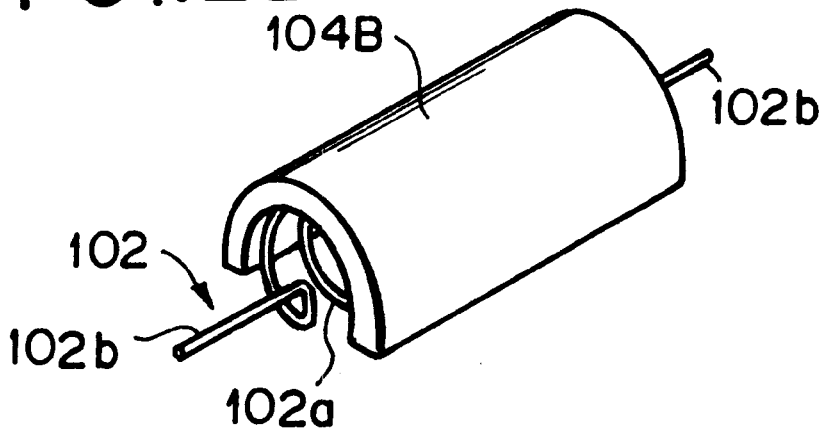
Figure 12C:
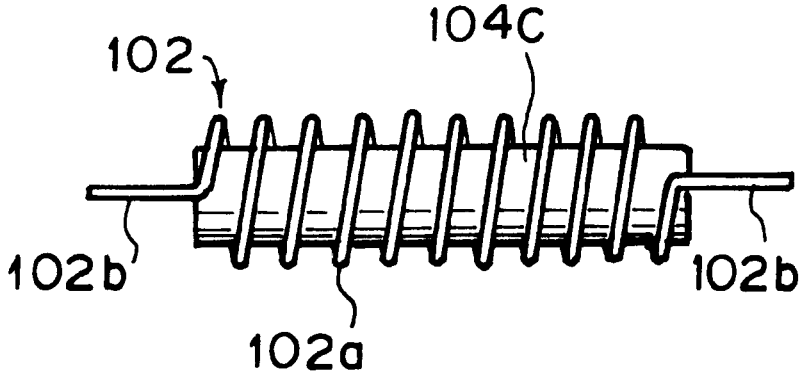

The molded body 104 may be of various shapes other than a ring as shown in FIGS. 12A to 12C.

The molded body 104A shown in FIG. 12A is in the form of a tube or a sleeve. The holding portion 102*a* of the flame reaction material carrier 102 is inserted into the molded body 104A and the molded body 104A is heated. The molded body 104B shown in FIG. 12B is in the form of a channel. The molded body 104B is placed on the holding portion 102*a* of the flame reaction material carrier 102 and is heated. The molded body 104C shown in FIG. 12C is in the form of a rod. The molded body 104B is inserted into the holding portion 102*a* of the flame reaction material carrier 102 and is heated.

In the case of flame reaction material for magenta flame, the flame reaction material may comprise a 40:50:10 composition of $Li_2Co_3$, $SiO_2$ and $Al_2O_3$ mixed with 30% of low-melting glass frit. In the case of flame reaction material for orange yellow flame, the flame reaction material may comprise a 67:33 composition of $Na_2Co_3$ and $SiO_2$ mixed with 30% of low-melting glass frit.

Figure 13A:
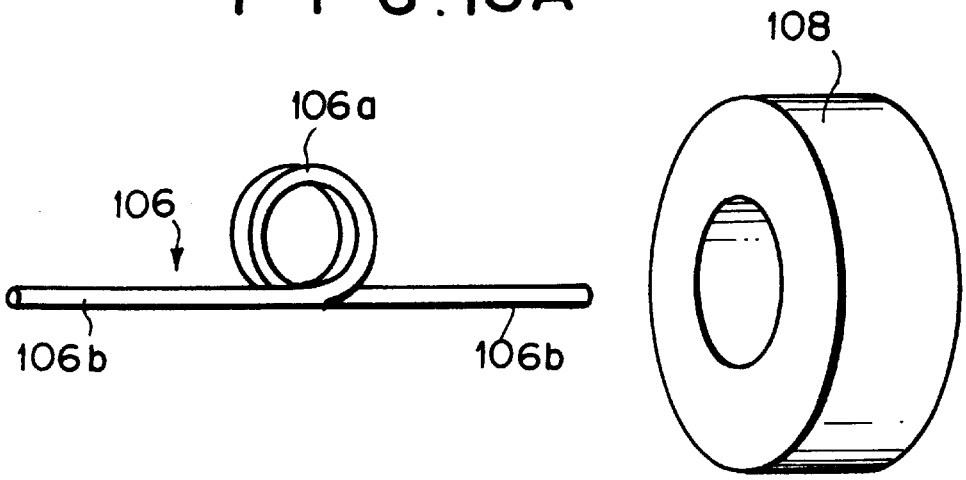
Figure 13B:
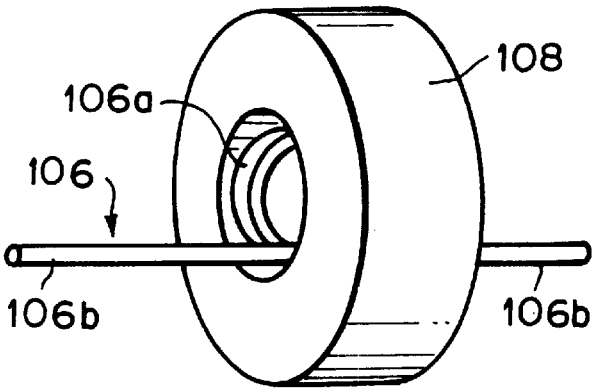

A method of manufacturing a flame reaction member in accordance with another embodiment of the present invention will be described with reference to FIGS. 13A to 13C, hereinbelow.

Figure 13C:
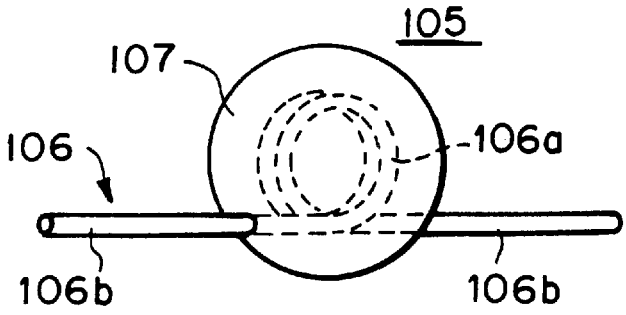

In this embodiment, the flame reaction member 105 to be manufactured comprises ball-like flame reaction material 107 carried by a looped flame reaction material holding portion 106*a* of a flame reaction material carrier 106 formed of heat-resistant wire material as shown in FIG. 13C.

As shown in 13A, a flame reaction material carrier 106 and a molded body 108 of a flame reaction material composition are first prepared. The flame reaction material carrier 106 is formed of a heat-resistant wire material such as nichrome wire and comprises the looped flame reaction material holding portion 106*a* and linear mounting portions 106*b* on opposite ends of the flame reaction material holding portion 106*a*. The flame reaction material holding portion 106*a* is formed by looping the wire material 1 to about 5 turns. The molded body 108 is in the form of a ring substantially the same as that employed in the preceding embodiment. The composition of the flame reaction material 107 may be the same as that employed in the preceding embodiment.

Then the flame reaction material carrier 106 is inserted into the central opening of the ring-like molded body 108 so that the molded body 108 is held by the holding portion 106*a*. With this state, the molded body 108 is heated to a temperature above the melting point of the flame reaction component, whereby the molded body 108 is melted and the molten composition forms a ball around the holding portion 106*a* under surface tension. Thereafter the ball of the molten composition is solidified and fused to the holding portion 106*a*. In this manner, the flame reaction member 105 shown in FIG. 13C is formed.

For example, the holding portion 106*a* of the flame reaction material carrier 106 is formed by winding twice nichrome wire material 0.15 mm in diameter into a loop which is 1.1 mm in outer diameter and 0.8 mm in inner diameter.

The powder composition of the blue green flame reaction material which is the same as that employed in the preceding embodiment is charged in a mold and pressed into a ring-like molded body 108. The molded body 108 may be, for instance, 3.1 mm in outer diameter, 1.2 mm in inner diameter, 1.5 mm in thickness and 10 mg in weight.

When the molded body 108 is fused to the holding portion 106*a*, the molded body 108 is heated to 900° C. for 10 minutes.

Figure 14A:
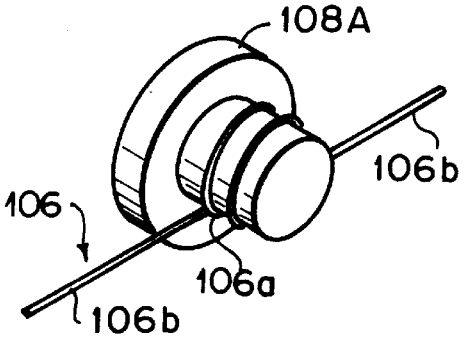
FIGS. 14A to 14F are perspective views showing modifications of the molded body shown in FIG. 13A.
Figure 14B:
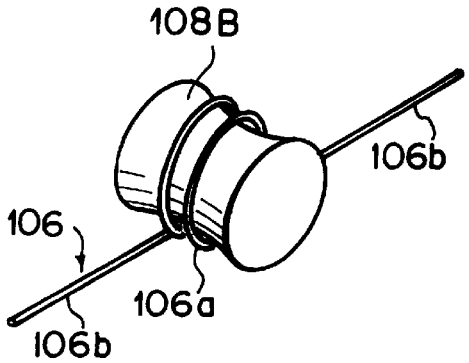
Figure 14C:
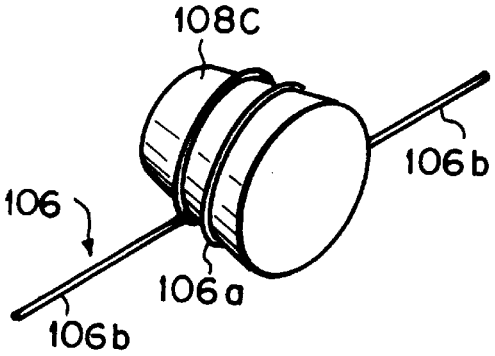
Figure 14D:
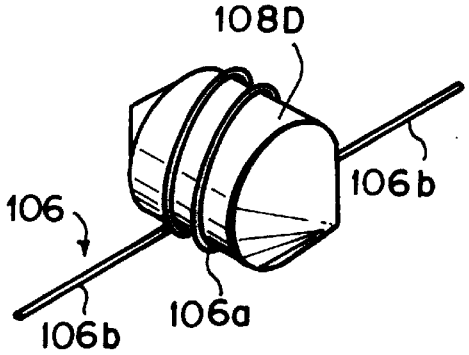
Figure 14E:
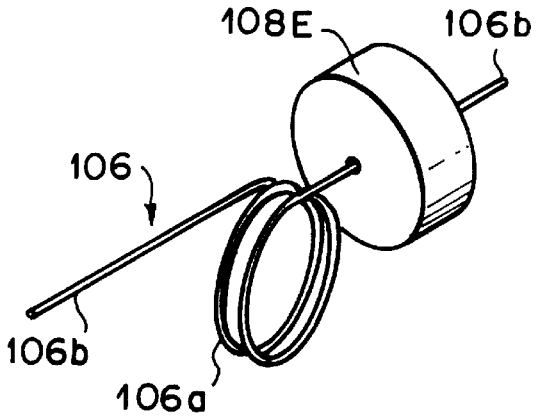
Figure 14F:
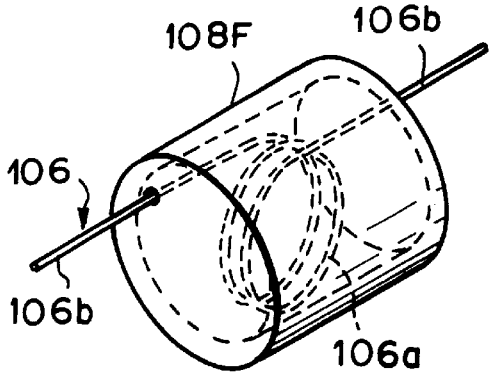

The molded body 108 may be of various shapes other than a ring as shown in FIGS. 14A to 14F. The molded bodies 108A to 108D shown in FIGS. 14A to 14D are shaped so that at least a part of each molded body can be inserted into the looped holding portion 106*a* of the flame reaction material carrier 106. Each of the molded bodies 108A to 108D is heated with at least a part inserted into the holding portion 106*a*. The molded bodies 108E and 108F shown in FIGS. 14E and 14F are shaped so that the mounting portion 106*b* of the flame reaction material carrier 106 can inserted thereinto and the molded bodies are heated with the mounting portion 106*b* inserted thereinto.

The molded bodies in the preceding embodiments may be sintered before being applied to the flame reaction material carrier.

That is, the molded body obtained by pressing the powder composition of the flame reaction material is sintered by heating for a predetermined time (e.g., 30 minutes) to a temperature (e.g., 500° C.) lower than the melting point (e.g., 750° C.) of the glass frit contained in the composition. The sintered molded body may be fused to the holding portion in the same manner as described above.

By the sintering treatment, the molded body is strengthened and is prevented from being broken or cracked upon setting it to the holding portion, e.g., when inserting the holding portion into the molded body or inserting the molding body into the holding portion.

A method of manufacturing a flame reaction member in accordance with still another embodiment of the present invention will be described, hereinbelow.

In this embodiment, a glassy composition of flame reaction material is melted and the molten composition is molded into a body of a predetermined shape such as a tube, bead, rod, ball or the like, and the molded body is fused to the flame reaction material carrier.

For example, a composition of the flame reaction material is melted and molded into a glass tube having an outer diameter of 0.3 mm and an inner diameter of 1.2 mm. The glass tube is cut into ring-like molded bodies having a length of 2.0 mm. Then the holding portion of the flame reaction material carrier is inserted into the molded body and the molded body is heated to 900° C. for 10 minutes, thereby fusing the molded body to the holding portion.

Otherwise the powder composition of the flame reaction material may be melted and molded into a round glass rod having a diameter of 0.7 mm. The glass rod is cut into molded bodies of 6.0 mm. The molded body is inserted into the coiled holding portion (0.15 mm in diameter of the wire material, 0.8 mm in inner diameter, 0.3 mm in pitches, 6.4 mm in length) and is heated to 900° C. for 10 minutes, thereby fusing the molded body to the holding portion.

The flame reaction material carriers having a holding portion formed of flat wire material described above in conjunction with FIGS. 1 to 10 can be also employed in the method of the present invention.

What is claimed is:

1. A flame reaction arrangement comprising a coiled or looped flame reaction material holding portion formed by winding heat-resistant wire material which is flat in cross-section and a body of flame reaction material affixed to the flame reaction material holding portion.

2. A flame reaction arrangement as defined in claim 1 in which said flame reaction material holding portion is formed by winding the wire material so that the flat sides of the wire material are parallel to the center line about which the flame reaction material holding portion is wound.

3. A flame reaction arrangement as defined in claim 1 in which said flame reaction material holding portion is formed by winding the wire material so that the flat sides of the wire material are perpendicular to the center line about which the flame reaction material holding portion is wound.

4. A flame reaction arrangement as defined in claim 1 in which said flame reaction material holding portion is formed by winding the wire material so that the flat sides of the wire material are at an angle to the center line about which the flame reaction material holding portion is wound.

5. A flame reaction arrangement as defined in claim 1 in which the flame reaction material is fused to the flame reaction material holding portion.

* * * * *